US007922457B2

(12) United States Patent
Lindsey et al.

(10) Patent No.: US 7,922,457 B2
(45) Date of Patent: Apr. 12, 2011

(54) SYSTEM AND METHOD FOR CONTROLLING A VARIABLE SPEED COMPRESSOR DURING STOPPING

(75) Inventors: James R. Lindsey, Denver, NC (US); James D. Mehaffey, Mooresville, NC (US); Richard Mauney, Mooresville, NC (US)

(73) Assignee: Ingersoll-Rand Company, Montvale, NJ (US)

( * ) Notice: Subject to any disclaimer, the term of this patent is extended or adjusted under 35 U.S.C. 154(b) by 1260 days.

(21) Appl. No.: 11/362,460

(22) Filed: Feb. 24, 2006

(65) Prior Publication Data

US 2006/0193728 A1 Aug. 31, 2006

Related U.S. Application Data

(60) Provisional application No. 60/656,753, filed on Feb. 26, 2005.

(51) Int. Cl.
*F04B 49/06* (2006.01)
*F04B 49/00* (2006.01)

(52) U.S. Cl. ..... 417/44.2; 417/26; 417/12; 417/53

(58) Field of Classification Search ..... 417/44.2, 417/26, 12, 53
See application file for complete search history.

(56) References Cited

U.S. PATENT DOCUMENTS

| | | | | |
|---|---|---|---|---|
| 3,692,430 | A * | 9/1972 | Timmons | 417/26 |
| 4,335,582 | A | 6/1982 | Shaw et al. | |
| 5,515,676 | A | 5/1996 | Earle et al. | |
| 5,820,352 | A * | 10/1998 | Gunn et al. | 417/53 |
| 6,450,771 | B1 * | 9/2002 | Centers et al. | 417/12 |
| 6,474,950 | B1 * | 11/2002 | Waldo | 417/44.2 |
| 6,530,240 | B1 | 3/2003 | Kountz et al. | |

FOREIGN PATENT DOCUMENTS

CN 1534194 A 10/2004

* cited by examiner

*Primary Examiner* — Devon C Kramer
*Assistant Examiner* — Peter J Bertheaud
(74) *Attorney, Agent, or Firm* — Michael Best & Friedrich LLP

(57) ABSTRACT

A compressor system operable to shutdown in response to a shutdown signal. The compressor system includes a compression device operable between a first speed and a second speed to produce a flow of compressed fluid at a pressure. A blowdown valve is movable between a closed position and an open position in which at least a portion of the flow of compressed fluid passes through the blowdown valve to reduce the pressure of the flow of compressed fluid. A sensor is positioned to measure the pressure and a controller is operable to move the blowdown valve to the open position and set the speed of the compression device to a low set point speed in response to the shutdown signal.

20 Claims, 2 Drawing Sheets

SYSTEM AND METHOD FOR CONTROLLING A VARIABLE SPEED COMPRESSOR DURING STOPPING

CROSS-REFERENCE TO RELATED APPLICATIONS

Priority is hereby claimed to U.S. Provisional Patent Application No. 60/656,753 filed on Feb. 26, 2005, the entire contents of which are incorporated herein by reference.

BACKGROUND

The invention relates to air compressors. More particularly, the invention relates to a method of controlling a variable speed compressor during stopping.

Conventional rotary air compressors have an inlet valve that controls air flow to the inlet or suction side of the compressor. The inlet valve throttles flow when load on the compressor is diminished and shuts fully when the load on the compressor is removed. The inlet valve is commonly referred to as an unloader valve. The compressor is loaded when the inlet valve is open permitting air to flow through the compressor inlet. The compressor is unloaded when the valve is closed to block flow through the compressor inlet.

Unloader valves are typically designed to prevent backflow through the compressor inlet. Backflow typically includes a pressurized fluid (e.g., a mixture of air and oil) and may occur when the compressor is stopped while the discharge side of the compressor is still pressurized. This negative pressure gradient allows flow out the inlet in the reverse direction.

U.S. Pat. No. 6,474,950, fully incorporated herein by reference, describes a screw compressor including a variable speed drive. Using variable frequency drive technology with air compressors allows delivery-side pressure to be controlled by varying the drive speed without the need for an inlet valve to control the system pressure. However, when an inlet valve is not utilized, backflow as described above occurs through the inlet of the compressor when the compressor is stopped.

SUMMARY

In one embodiment, the invention provides a compressor system operable to shutdown in response to a shutdown signal. The compressor system includes a compression device operable between a first speed and a second speed to produce a flow of compressed fluid at a pressure. A blowdown valve is movable between a closed position and an open position in which at least a portion of the flow of compressed fluid passes through the blowdown valve to reduce the pressure of the flow of compressed fluid. A sensor is positioned to measure the pressure and a controller is operable to move the blowdown valve to the open position and set the speed of the compression device to a low set point speed in response to the shutdown signal.

In another embodiment the invention provides a compressor system that includes a compression device including a compressor having a sump, and a variable speed drive coupled to the compressor. The compression device is operable to produce a flow of compressed fluid having a pressure. A blowdown valve is movable between a closed position and an open position in which at least a portion of the flow of compressed fluid passes through the blowdown valve to reduce the pressure of the flow of compressed fluid. A pressure sensor is positioned to measure the pressure of the flow of compressed fluid and a sump pressure sensor is positioned to measure a sump pressure within the sump. A controller is operable to move the blowdown valve to the open position and set the speed of the compression device to a low set point speed in response to a measured pressure of the flow of compressed fluid in excess of a predetermined pressure, and one of reduce the speed of the compression device from the low set point speed to a third speed lower than the low set point speed in response the passage of a predetermined length of time and reduce the speed of the compression device from the low set point speed to zero in response to a measured sump pressure below a predetermined sump pressure.

In another embodiment, the invention provides a method of operating a compressor with a compression stage that increases a pressure of a fluid flowing therethrough. The method includes sensing a compressed fluid pressure downstream of the compression stage, sending a signal indicative of the compressed fluid pressure to a controller, and starting a shutdown timer at an initial value in response to the signal. The method also includes opening a blowdown valve to relieve compressed fluid pressure in response to the signal and sending a stop signal from the controller to a variable frequency drive to stop the compressor when the shutdown timer reaches a final value.

Other aspects of the invention will become apparent by consideration of the detailed description and accompanying drawings.

BRIEF DESCRIPTION OF THE DRAWINGS

The invention may be more fully understood with reference to the accompanying figures. The figures are intended to illustrate exemplary embodiments without limiting the scope of the invention.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
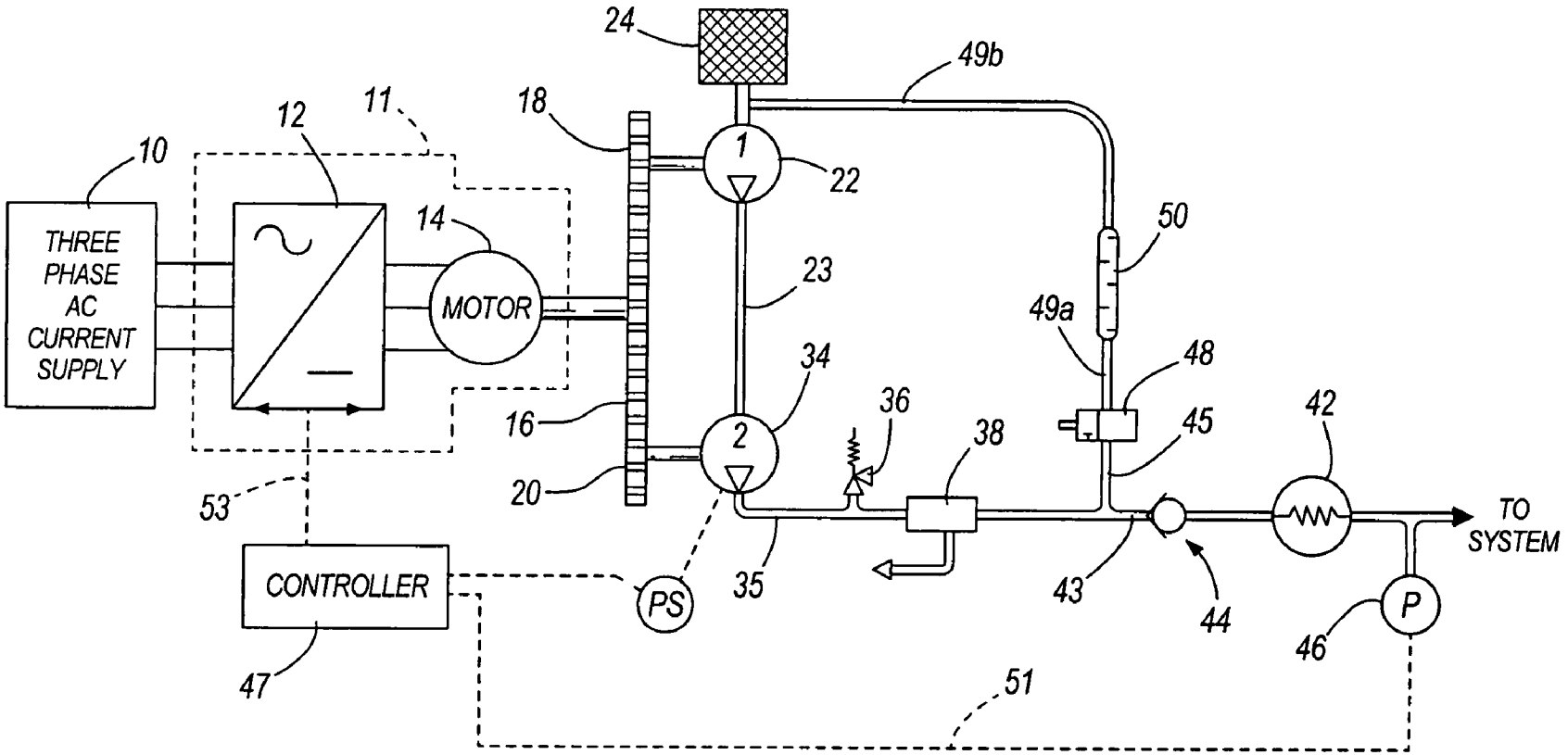
FIG. 1 is a schematic diagram showing a compressor system according to one embodiment.

Referring now to FIG. 1, one embodiment of a compressor system is illustrated. As shown in FIG. 1, a three-phase AC power supply 10 provides three phase alternating current to a variable speed drive arrangement 11 including a rectifier/inverter drive 12. The rectifier/inverter drive 12 provides a variable speed drive signal to an electric motor 14. The drive 12 can rectify alternating current from the AC power supply to DC current, and invert DC current to an AC current having a varying frequency as a means of providing a variable power supply to the motor 14. With such a drive 12, a standard induction motor can be used. Alternatively, other types of drives and drive arrangements can be used provided they are coupled with an appropriate variable speed motor that is not significantly limited by the number of times it can start and stop over a given period of time.

In the illustrated embodiment, the electric motor 14 rotates a main gear 16 that engages two secondary gears 18, 20 which respectively drive a first stage airend 22 and a second stage airend 34. In the illustrated embodiment, each of the first stage airend 22 and the second stage airend 34 compresses fluid with a compression element (e.g., a rotatable screw). The invention is not limited to the specific type of compression device or compressor system as illustrated. Those of skill in the art will appreciate that the invention may be adapted to a multitude of different compressor systems.

The first stage airend 22 has a fluid intake 23 and a filter 24 upstream of the fluid intake 23. The fluid processed by the system is preferably a gas, such as air, and the filter 24 is preferably a gas filter in such a case. The filter 24 cleans the fluid before it is compressed in the first stage airend 22. A primary compressed fluid exits the first stage airend 22 and passes through a compressed fluid conduit 23 to the second stage airend 34. The second stage airend 34 receives the primary compressed fluid at a first pressure (for example, from about 30 psig to about 40 psig) and compresses the primary compressed fluid to a second pressure (for example, from about 100 psig to about 150 psig) to form what is referred to herein as a secondary compressed fluid.

The secondary compressed fluid exits the second stage airend 34 and flows through a conduit 35 to a lubricant/gas separator 38. The separator 38 removes lubricant (part or all of which may then be routed to an oil cooler in some embodiments) from the secondary compressed fluid. Along conduit 35, between the second stage airend 34 and the separator 38, a pressure relief valve 36 is provided. The relief valve 36 is triggered open when the pressure in conduit 35 exceeds a predetermined relief pressure. The relief valve 36 opens to avoid any damage to piping or other system components that can be caused by excessive high pressure, and will typically not be used in order to modulate the downstream pressure. The secondary compressed fluid is desired to exit the second stage airend 34 with a pressure within a pressure band, referred to herein as a second stage pressure band. In some embodiments, the relief valve 36 opens at a relief pressure of from about 5 percent to about 15 percent, over an upper limit of the second stage pressure band, although any of a variety of triggering pressures can be used. For example, if it is desired that secondary compressed fluid exiting the second stage airend 34 is within a pressure band of from about 100 psig to about 150 psig, the relief valve 36 can be configured to trigger open when a compressed secondary fluid pressure from about 160 psig to about 170 psig is obtained. This is purely exemplary, and those of skill in the art will realize that the pressure band and the relief valve 36 can be configured in many other ways.

The secondary compressed fluid exits the separator 38 relatively free of lubricant and flows through a conduit 43 and a check valve 44 and from there to an after cooler 42. Excess heat from compression is removed from the secondary compressed fluid at the after cooler 42. Between the after cooler 42 and a final delivery point, the secondary compressed fluid may flow through a moisture separator or dryer (not shown) to remove moisture or reduce the likelihood of moisture condensing out of the fluid. After passing through the separator 38 and the after cooler 42, (and the optional dryer) the secondary compressed fluid is in condition for delivery to downstream components in a compressed fluid usage system and is therefore referred to as compressed delivery fluid. Along conduit 43, between after cooler 42 and the separator 38, a blowdown device is provided. In the embodiment shown in FIG. 1, the blowdown device includes a conduit 45 that links conduit 43 to a blowdown valve 48.

In some embodiments, the blowdown valve 48 includes a solenoid type device for controlling the state of the valve 48 based on a signal (e.g., electrical or pneumatic signal). The blowdown valve 48 is controlled by signals sent from a control unit or controller 47. The signal transmission line to blowdown valve 48 from controller 47 is not shown in FIG. 1. Upon receiving a signal from controller 47 to open the blowdown valve 48, the valve 48 is actuated to achieve an open position whereby secondary compressed fluid is able to flow through conduit 45, through blowdown valve 48, through a conduit 49*a* in communication with the blowdown valve 48, through a silencer 50, and to the intake 23 (or a volume in communication with the intake 23) of the first stage airend 22 via a conduit 49*b*. The silencer 50 can be a conventional muffler or virtually any silencer known to those of ordinary skill in the art. In alternate embodiments, when opened, the blowdown valve 48 allows secondary compressed fluid to flow through conduit 45, through the valve 48, and out to the atmosphere (either with or without the silencer 50). In some embodiments, the valve 48 is a variable flow valve and is capable of being positioned in various incremental open positions. The valve 48 can be controlled by the controller 47 to work cooperatively with compressor speed to achieve desired changes in downstream pressure as described in greater detail below.

According to some embodiments, as exemplified in FIG. 1, a pressure sensor 46 may be provided downstream of the check valve 44 and the after cooler 42. In the illustrated embodiment, the pressure sensor 46 is in communication with a fluid conduit leading to the compressed fluid usage system and senses the pressure of the compressed delivery fluid just upstream of the compressed fluid usage system. The pressure sensor 46 may be located at various places in the compressor system as long as it is configured to sense a downstream pressure (i.e., downstream of at least one compression stage) and is calibrated to achieve desired outcomes as described in more detail below. A signal indicative of the sensed pressure is sent from the pressure sensor 46 along a signal line 51 to the controller 47. In response to the signal received from the pressure sensor 46, the controller 47 generates a drive signal that is sent along the signal line 53 to the rectifier/inverter drive 12. The signal sent from controller 47 along line 53 controls the rectifier/inverter drive output so as to adjust the speed of motor 14 and thereby adjust the further pressurization of fluid in the compressor system via the airends 22 and 34. In some situations, the drive signal sent from controller 47 along line 53 to drive 12, in combination with the state of the blowdown valve 48, collectively control the downstream pressure in the compressor system within a pressure band while reducing energy usage. In addition, because the drive 12 and motor 14 are capable of performing a significant number of starts and stops over a given period of time, energy savings are optimized by increasing shutdown time (either by increasing the number of shutdown periods or by increasing the duration of shutdown periods, or a combination of both).

Since the compressor system does not require an inlet valve upstream of the first airend 22 (e.g., a throttling butterfly valve), the compressor system of the illustrated embodiment eliminates such an inlet valve to reduce the cost and complexity of the system. Without a conventional inlet valve, there is a potential for backflow of working fluid through the compressor intake 23. The backflow can be harmful to the compressor in some cases and is often undesirable for additional reasons, some of which are described in further detail below. In the case of a contact-cooled compressor, backflow can include fine oil droplets and compressed air to be ejected through the compressor intake 23, and in some cases, out into the surrounding atmosphere. The pressure control system and method such as that described herein greatly reduce or eliminate the probability of backflow. In some embodiments, this is accomplished by strategically decreasing the pressure in the compressor system, specifically in the compressor airends 22 and 34, prior to shutting down. Reduction of the pressure can be achieved by operating the compressor at a low speed while the compressor system is in the blowdown mode (i.e., blowdown valve 48 in the open condition).

Figure 2:
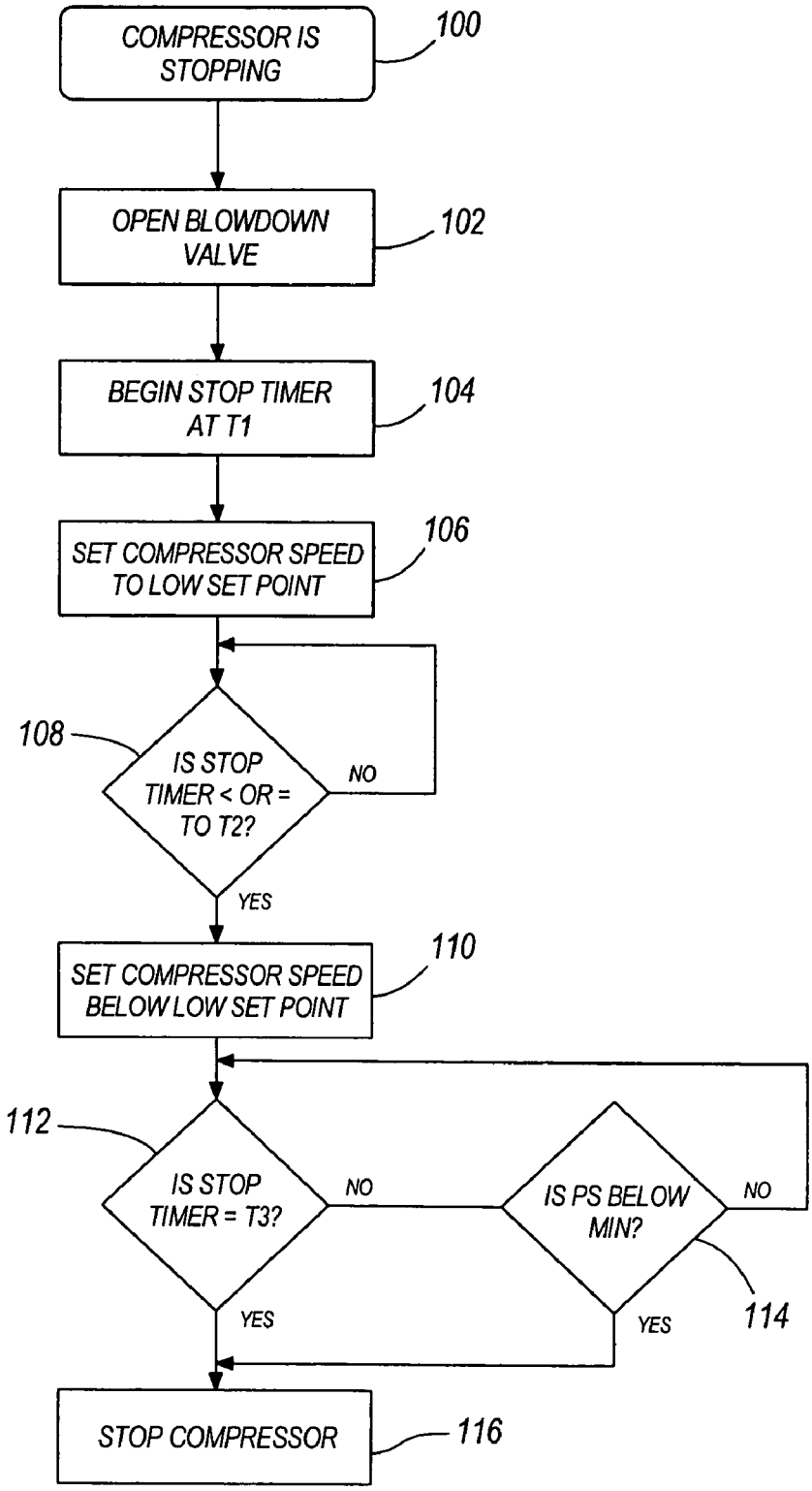
FIG. 2 is a flow diagram of the logic control involved with carrying out a method according to one embodiment.

A flow chart showing the logic control for stopping the compressor in accordance with one embodiment of the invention is shown in FIG. 2. In the logic flow diagram of FIG. 2, the controller 47 receives a signal to stop the compressor (i.e., stop compression) at block 100. Compression may be stopped or significantly limited in many ways. One exemplary method of stopping compression is to stop the motor 14 by stopping the drive 12. When the motor 14 is stopped, a compression element drivingly connected to the motor 14, is then also stopped. The stop control signal can be based on various factors as described above and can be configured to operate the compressor system in various manners. Once the signal to stop compression is received, the controller logic will open the blowdown valve 48 as shown at block 102. At that time, the controller 47 starts a timer (e.g., a stop timer) as shown at block 104 and sets the compressor speed to a low set point as shown at block 106. The low set point can be a predetermined value of compressor speed, which is set as a relative minimum speed for compressor operation (i.e., the lowest compressor speed during periods other than shut down). Other compressor speeds may also be used as the default speed in other embodiments when the blowdown valve 48 is open.

A timer initial value T1 can be set at any desired value, for example, the timer initial value T1 may be set to 30 seconds. This will allow a period of time before fully stopping the compressor. The compressor can be fully stopped when the timer reaches a final value T3. The timer may prevent an unneeded stop and start of the compressor in the event the demand of the compressed fluid usage system is just momentarily low. The controller 47 will continue operating the compressor at the low set point until the timer value reaches a predetermined slow down time T2, which is monitored at block 108 of FIG. 2. The system is configured such that the controller 47 will lower the compressor speed below the low set point when the timer reaches T2, as shown at block 110 of FIG. 2. For example, compressor speed can be set to a value 50 percent of the low set point at the slow down time T2 to allow the pressure within the airends 22 and 34 to reduce before final stopping of the compressor. The slow down time T2 may, for example, be set to 15 seconds in an embodiment in which the timer initial value T1 is 30 seconds.

The compressor system may also be provided with a sump pressure sensor PS to monitor the pressure within a sump of the compressor system. In the illustrated embodiment, the sump pressure sensor PS is configured to sense a fluid pressure within a sump of the second stage airend 34 and send a corresponding signal indicative of that fluid pressure to the controller 47. A fluid pressure in a sump of the first stage airend 22 is monitored in some embodiments. In the event a signal indicative of sump pressure indicates a sump pressure less than a predetermined value, the controller 47 will send a stop signal to stop the compressor. The predetermined value is selected such that if the compressor is stopped, the predetermined value of sump pressure is sufficiently low that backflow will not occur. As shown in FIG. 2, the sump pressure is monitored once the compressor speed is set to a speed below the low set point (i.e., timer value has reached T2). This allows stopping of the compressor based on the signal from the sump pressure sensor PS before the timer value has reached the final value T3.

The controller logic allows the compressor to reduce speed when signaled to blow down. The sequencing of lowering the compressor speed and the amount of time the blowdown valve 48 is open reduces or eliminates backflow at the compressor inlet. In some embodiments, the controller 47 is configured to stop the compressor when the sump pressure is less than the predetermined value even before the timer has reached the slow down time T2. In such embodiments, block 114 (shown in FIG. 2) for comparing the sump pressure signal to the predetermined value may be relocated in parallel with block 108 that compares the timer value to the slow down time T2.

Although the embodiment shown in FIG. 1 features a two-stage compressor system, the invention further encompasses single stage compressors and compressor systems having three or more stages of compression, in combination with a variable speed drive. Furthermore, the embodiment shown in FIG. 1 indicates that a single motor 14 and variable speed drive 12 are used to control both the first and second airends 22 and 34, but it should be recognized by those skilled in the art that individual variable speed drives and motors can be used for each of the first and second airends 22 and 34, respectively.

Although the illustrated variable speed drive arrangement 11 includes a rectifier/inverter drive 12, it should be recognized by those of skill in the art that other variable speed drive systems and components can be employed, including variable speed drives designed to cycle through a large number of starts and stops over a given period of time with little wear or harm to the system. Another exemplary system employs a controllable DC power source that directly powers a variable speed electric motor.

The components illustrated and described herein represent only one embodiment and arrangement of a compressor system. In addition to the components illustrated and described herein, many individual components known to those skilled in the art, may also be used in replacement or in addition. Those of skill in the art will realize that the function of the invention is not dependent upon all the components shown and described and is not necessarily dependent upon the exact placement of given components in the system. Compressor systems of many constructions not shown or described herein can certainly incorporate the structure and/or methods as claimed in the appended claims.

A compressor system is provided having a pressure control design that eliminates the inlet valve conventionally used in compressors. According to the invention, pressure in the compressor is controlled by controlling the compressor speed with a variable speed drive arrangement 11, and relieving or blowing down the pressure in the final stage with the blowdown valve 48, which is, for example, a solenoid-operated valve. When a volumetric demand in the system can be exceeded with the compressor driven at its low set point, a motor start/stop control is employed to stop the compressor until the stored pressure is used or the volume demand rises. Herein, the term compressor speed relates to the speed of a compression element, for example, a screw in an airend. In some embodiments, the compressor speed is directly related to the speed of a driving element, such as a motor and, in some cases, also including a transmission device.

The variable speed drive arrangement 11 maintains a relatively constant downstream pressure in the system by speeding up or slowing down one or more compressor stages of the system in response to a signal indicative of a pressure sensed in a compressed fluid conduit downstream of the compressor stages, such as sensed by the sensor PS. The downstream pressure can be maintained within a target pressure band by speeding up or slowing down the variable speed drive arrangement 11 provided the target pressure band can be maintained by operating in the acceptable speed range of the compressor. When the downstream pressure begins to rise and approach the maximum value of the desired pressure band, the controller 47 receives the signal indicative of the sensed pressure and controls the drive arrangement 11 to slow down the compressor. If pressure in the system continues to rise after the compressor has been slowed down to its low set point, the controller 47 will cease to control pressure by varying the speed of the variable speed drive arrangement 11, but by starting and stopping the drive arrangement 11. The starting and stopping will continue so as to keep the downstream pressure within the acceptable pressure band. The drive arrangement 22 is capable of a large number of starts and stops due to its "soft-starting" nature, which ramps-up current. When a significant demand recurs, the controller 47 will control the compressor speed via the variable speed drive arrangement 11 to maintain the downstream pressure within the desired pressure band.

When the downstream pressure reaches the maximum threshold value, the blowdown valve 48 may open to relieve final stage pressure (in addition to slowing down the compressor). When the downstream pressure falls below a predetermined threshold level, the blowdown valve 48 closes. In some embodiments, once started, the compressor is run at the low set point unless a relatively high demand exists. The control reduces the overall power required to maintain system gas pressure by matching the compressor input power to the required flow and by shutting off the drive arrangement 11 when there is no demand for gas flow. The system design reduces the need to relieve excess pressure and thus conserves energy otherwise lost by blowing down.

The compressor system described herein is particularly useful in the pressurization of air or gas. The compressor system provides a compressed air pressure control across a 0 percent to 100 percent compressed air volume demand. Because the compressor system reduces power consumption proportionately to the system demand and achieves zero compressor power when there is no demand (or substantially low demand), the system consumes much less energy than previously developed compressor systems that do not use variable speed drives.

It should be noted that the foregoing description discusses a system that shuts down a compressor or compressors in response to the output pressure of the compressors exceeding a predetermined value. However, the system described herein can be used to shut down a compressor or compressors in response to any condition that requires a shutdown. As such, many systems include a shutdown signal that starts the shutdown process. This shutdown signal can be generated by any one event, measurement, or action, or combination of events, measurements, or actions. For example, an operator may initiate a shutdown by depressing a stop button. Furthermore, a high oil temperature or low oil level may initiate a shutdown signal. As such, the invention should not be limited to applications in which the shutdown is a result of a high pressure reading alone.

It will be apparent to those skilled in the art that various modifications and variations can be made to the embodiments of the invention without departing from the spirit or scope of the invention. Thus, it is intended that the invention cover other modifications and variations within the scope of the appended claims and their equivalents.

What is claimed is:

1. A compressor system operable to shutdown in response to a shutdown signal, the compressor system comprising:

a compression device including a fluid intake and a fluid output, the compression device operable between a first speed and a second speed to produce a flow of compressed fluid at an output pressure from a flow of fluid at an intake pressure;

a blowdown valve positioned downstream from a lubricant/fluid separator and movable between a closed position and an open position in which at least a portion of the flow of compressed fluid passes through the blowdown valve to reduce the output pressure of the flow of compressed fluid;

a sensor positioned to measure a downstream pressure and generate the shutdown signal in response to a measured downstream pressure in excess of a predetermined pressure; and a controller operable to move the blowdown valve to the open position and set the speed of the compression device to a low set point speed in response to the shutdown signal, in order to decrease the output pressure to a level below the operating pressure range; and further comprising a timer operable to monitor the passage of time, and wherein the controller reduces the compression device speed to a third speed below the low set point speed in response to the passage of a first predetermined period of time.

2. The compressor system of claim 1, wherein the compression device includes a variable speed drive.

3. The compressor system of claim 1, wherein the controller reduces the compression device speed to zero in response to the passage of a second predetermined period of time.

4. The compressor system of claim 1, further comprising a sump sensor positioned in a sump and configured to provide a signal to the controller indicative of the pressure in the sump.

5. The compressor system of claim 4, wherein the controller reduces the compression device speed to zero in response to a measured sump pressure below a predetermined sump pressure.

6. The compressor system of claim 1, wherein the blowdown valve includes a solenoid-operated valve.

7. The compressor system of claim 1, wherein the compression device includes at least one contact-cooled compressor.

8. The compressor system of claim 1, wherein the low set point speed is lower than the first speed and the second speed.

9. The compressor system of claim 1, further comprising a sump sensor positioned in a sump and configured to provide a signal to the controller indicative of the pressure in the sump, and a timer operable to monitor the passage of time, and wherein the controller reduces the compression device speed from the low set point speed to zero in response to one of the passage of a predetermined length of time and the measured sump pressure below a predetermined pressure.

10. The compressor system of claim 1, wherein a conduit provides fluid communication between the blowdown valve and the fluid intake of the compression device to direct the portion of the flow of compressed fluid that passes through the blowdown valve to the intake.

11. A compressor system comprising:

a compression device including a variable speed drive coupled to a compressor having a fluid intake, a fluid output, and a sump, the compression device operable between a first speed and a second speed to produce a flow of compressed fluid at an output pressure from a flow of fluid at an intake pressure;

a blowdown valve movable between a closed position and an open position in which at least a portion of the flow of compressed fluid passes through the blowdown valve to reduce the output pressure of the flow of compressed fluid;

a pressure sensor positioned to measure a downstream pressure of the flow of compressed fluid;

a sump pressure sensor positioned to measure a sump pressure within the sump; and a controller operable to:

move the blowdown valve to the open position, set the speed of the compression device to a low set point speed in response to a measured downstream pressure of the flow of compressed fluid in excess of a predetermined pressure, and one of reduce the speed of the compression device from the low set point speed to a third speed lower than the low set point speed in response to the passage of a predetermined length of time and reduce the speed of the compression device from the low set point speed to zero in response to a measured sump pressure below a predetermined sump pressure, in order to decrease the output pressure to a level below the operating pressure range; and wherein the controller reduces the speed of the compression device from the third speed to zero in response to the passage of a second predetermined length of time, the second predetermined length of time starting in response to the passage of the predetermined length of time.

12. The compressor system of claim 11, further comprising a timer operable to output a signal indicative of the passage of time.

13. The compressor system of claim 12, wherein the timer begins a timing cycle in response to the measured downstream pressure of the flow of compressed fluid in excess of the predetermined pressure.

14. The compressor system of claim 11, wherein the blowdown valve includes a solenoid-operated valve.

15. The compressor system of claim 11, wherein the compression device includes at least one contact-cooled compressor.

16. The compressor system of claim 11, wherein the low set point speed is lower than the first speed and the second speed.

17. The compressor system of claim 11, wherein a conduit provides fluid communication between the blowdown valve and the fluid intake of the compression device to direct the portion of the flow of compressed fluid that passes through the blowdown valve to the intake.

18. A method of shutting down operation of a compressor while preventing backflow through the compressor, the compressor having a compression stage that, in operation between first and second operating speeds, maintains a pressure of a fluid flowing therethrough within an operating pressure range, the method comprising:

sensing a compressed fluid pressure downstream of the compression stage;

sending a signal indicative of the compressed fluid pressure to a controller;

starting a shutdown timer at an initial value in response to the signal;

opening a blowdown valve positioned downstream of the compression stage to relieve compressed fluid pressure in response to the signal;

setting the compressor speed to a speed lower than the first and second operating speeds in response to a sensed compressed fluid pressure in excess of a predetermined pressure; and sending a stop signal from the controller to a variable frequency drive to stop the compressor when the shutdown timer reaches a final value, such that the downstream pressure decreases to a level below the operating pressure range; and further comprising reducing the compressor speed to a speed below the lower speed when the shutdown timer reaches a slow down time between the initial value and the final value of the timer.

19. The method of claim 18, further comprising sensing a sump pressure in a fluid sump of the compressor, sending a sump pressure signal indicative of the sump pressure to the controller, and sending the stop signal to the variable frequency drive when the sump pressure is below a predetermined sump pressure.

20. The method of claim 18, wherein the blowdown valve relieves excess compressed fluid pressure to an intake area of the compression stage.

* * * * *